US008985351B1

(12) United States Patent
Longo et al.

(10) Patent No.: US 8,985,351 B1
(45) Date of Patent: Mar. 24, 2015

(54) DISPLAY DEVICE

(75) Inventors: Vincent Longo, Huntington Beach, CA (US); Anthony Longo, Laguna Niguel, CA (US)

(73) Assignee: Todos Santos Surf, Inc., Huntington Beach, CA (US)

( * ) Notice: Subject to any disclaimer, the term of this patent is extended or adjusted under 35 U.S.C. 154(b) by 319 days.

(21) Appl. No.: 12/687,036

(22) Filed: Jan. 13, 2010

Related U.S. Application Data

(60) Provisional application No. 61/144,660, filed on Jan. 14, 2009.

(51) Int. Cl.
*A47F 5/02* (2006.01)
*A47F 3/04* (2006.01)

(52) U.S. Cl.
CPC ..... *A47F 3/0404* (2013.01)
USPC ..... 211/163; 211/85.7; 211/13.1

(58) Field of Classification Search
USPC ..... 211/196, 197, 85.7, 133.4, 67, 68, 95, 211/70.5, 205, 70, 166, 62, 70.2, 195, 163; 248/222.52, 222.13, 222.11, 222.51; 441/79
See application file for complete search history.

(56) References Cited

U.S. PATENT DOCUMENTS 505,320 A * 9/1893 Meadows ..... 211/64
699,391 A * 5/1902 Johnson ..... 211/70.2
1,257,107 A * 2/1918 Patterson ..... 211/64
1,418,093 A * 5/1922 Parmater ..... 211/15
1,563,137 A * 11/1925 Amsler ..... 248/158
3,172,585 A * 3/1965 Mahaney et al. ..... 294/143
3,722,652 A * 3/1973 Busch et al. ..... 194/256
3,788,489 A * 1/1974 Levinthal ..... 211/163
3,826,378 A * 7/1974 Novak ..... 211/70.5
4,516,616 A * 5/1985 Fesler ..... 150/154
4,527,760 A * 7/1985 Salacuse ..... 248/108
4,680,949 A * 7/1987 Stewart ..... 70/14
4,688,685 A * 8/1987 Brace ..... 211/70.5
5,090,277 A * 2/1992 Spiller ..... 81/488
5,158,179 A * 10/1992 Gosselin ..... 206/315.1
5,177,881 A * 1/1993 Moore ..... 34/239
5,230,117 A * 7/1993 Johnson et al. ..... 15/106
5,269,487 A * 12/1993 Heitzman ..... 248/489
5,366,075 A * 11/1994 Mills ..... 206/315.6
5,417,334 A * 5/1995 Wu ..... 211/70.2
5,458,243 A * 10/1995 McBride ..... 206/503
5,458,249 A * 10/1995 Shang-Lu ..... 211/197
5,586,664 A * 12/1996 Taylor ..... 211/58
5,676,261 A * 10/1997 Baughman et al. ..... 211/70
5,762,211 A * 6/1998 Ensign ..... 211/70.6
5,918,490 A * 7/1999 Lion ..... 70/58
5,984,380 A * 11/1999 Rice ..... 292/1
6,308,838 B1 * 10/2001 Endean ..... 211/37

(Continued)

*Primary Examiner* — Patrick Hawn
(74) *Attorney, Agent, or Firm* — Haynes and Boone, LLP

(57) ABSTRACT

A display device is provided which may be used to display surfboard fins and related product literature. In one example, a display device includes a plurality of tubes and machined parts which may be assembled and configured as further disclosed herein. Such a display device may be used, for example, to hold and secure surfboard fins to facilitate display of the fins and permit the handling of the fins by consumers. Advantageously, the display device may also be implemented to prevent the fins from being completely detached from the display device without the use of an appropriate security device. The display device may also be implemented to hold and secure information (e.g., product literature) associated with the fins.

24 Claims, 23 Drawing Sheets

(56) References Cited

U.S. PATENT DOCUMENTS

| | | | | |
|---|---|---|---|---|
| 6,837,386 | B1 * | 1/2005 | Kent et al. | 211/153 |
| 6,868,975 | B2 * | 3/2005 | Sells et al. | 211/4 |
| 7,971,845 | B2 * | 7/2011 | Galant | 248/551 |
| 2005/0064775 | A1 * | 3/2005 | White | 441/79 |
| 2006/0019559 | A1 * | 1/2006 | Mair et al. | 441/79 |
| 2007/0202760 | A1 * | 8/2007 | Caldwell et al. | 441/79 |
| 2008/0042033 | A1 * | 2/2008 | Risbara | 248/311.2 |
| 2008/0061016 | A1 * | 3/2008 | Nicolopulos et al. | 211/62 |
| 2008/0185354 | A1 * | 8/2008 | Hopper et al. | 211/62 |

* cited by examiner

DISPLAY DEVICE

CROSS-REFERENCE TO RELATED APPLICATIONS

This application claims the benefit of U.S. Provisional Patent Application Ser. No. 61/144,660 entitled, "FIN TREE DISPLAY DEVICE" filed Jan. 14, 2009, which is hereby incorporated by reference herein in its entirety.

BACKGROUND

1. Field of the Invention

The present invention generally relates to display devices and more particularly to display devices useful for displaying products for consumer inspection.

2. Related Art

When purchasing products, it is often advantageous for consumers to view products "in-person" which can aid consumers in making purchasing decisions. Such in-person inspections may allow consumers to evaluate products more accurately than would otherwise be available through inspection of a brochure or website. As a result, various types of display systems have been developed to present products to consumers.

In one example, products may be placed on shelves or other types of displays in a manner that provides consumers relatively unlimited control to pick up and/or otherwise interact with the product. However, in such an approach, the retailer or other displaying party retains little control over the products. As a result, products may be susceptible to theft, especially in the case of small consumer products such as surfboard fins.

In another example, products may be displayed in a secure fashion behind glass or another appropriate barrier to prevent theft. Unfortunately, this approach provides very little or no consumer interaction with the products, which can prevent consumers from sufficiently inspecting the products to the extent desired by the consumers.

Accordingly, there is needed an improved approach to the display of goods. In particular, there is a need for an approach to the display of surfboard fins in a manner that provides satisfactory levels of product security and consumer interaction.

SUMMARY

In one embodiment of the present invention, a display device is provided for publicly displaying surf products such as surfboard fins. The display device also includes a means for compactly clustering or grouping the fins in an generally horizontal, elevated, and mobile manner with the fins being individually or singularly secured and/or adapted in a suspended secure manner.

In another embodiment, the fins are suspended under a movable circular horizontal wheel secured to a vertical element such as a wall or alternatively the wheel may be mounted to a freestanding tube or pole and provide a consumer access to and the inspection of the individual or grouping of the fin or fins. In this display manner, the consumer may fully have access to inspect the fins but limit the complete removal of the fins from the display device. Additionally, the display device may provide areas adjacent to the fins for corresponding sales support materials that may be printed in single or multiple planes (e.g., three dimensionally displayed).

In another embodiment, a display device includes a trunk. The display device also includes a support member comprising an aperture adapted to receive the trunk therethrough. The display device also includes a security member adapted to secure an item to the support member for display and manipulation by a consumer without permitting complete removal of the item from the display device by the consumer. The display device also includes a collar adapted to secure the support member to the trunk. The collar is adapted to contact at least a bottom surface of the support member to hold the support member at least at a display position relative to a bottom end of the trunk. The collar comprises an aperture adapted to receive the trunk therethrough.

In another embodiment, a display device includes a trunk. The display device also includes a support member adapted to secure an item for display and manipulation by a consumer without permitting complete removal of the item from the display device by the consumer. The support member comprises an aperture adapted to receive the trunk therethrough. The support member comprises a slit extending from an outer surface of the support member to the aperture of the support member. The slit defines substantially opposite surfaces of the support member. The support member is adapted to receive a screw across the slit to pull the opposite sides together to exert pressure on the trunk to hold the support member at a display position relative to a bottom end of the trunk.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

Embodiments of the present invention and their advantages are best understood by referring to the detailed description that follows. It should be appreciated that like reference numerals are used to identify like elements illustrated in one or more of the figures.

DETAILED DESCRIPTION

In accordance with various embodiments disclosed herein, a display device is provided which may be used to display products and related product literature. For example, in one embodiment, a display device (also referred to as a fin tree) includes a plurality of tubes and machined parts which may be assembled and configured as further disclosed herein to display surfboard fins and related product information. Such a display device may be used, for example, to hold and secure the fins to facilitate display of thefts and permit the handling of the fins by consumers. Advantageously, the display device may also be implemented to prevent the fins from being completely detached from the display device without the permission of a retailer. The display device may also be implemented to hold and secure information (e.g., product literature) associated with the fins. Additional embodiments are also provided as will be further described herein.

Figure 1:
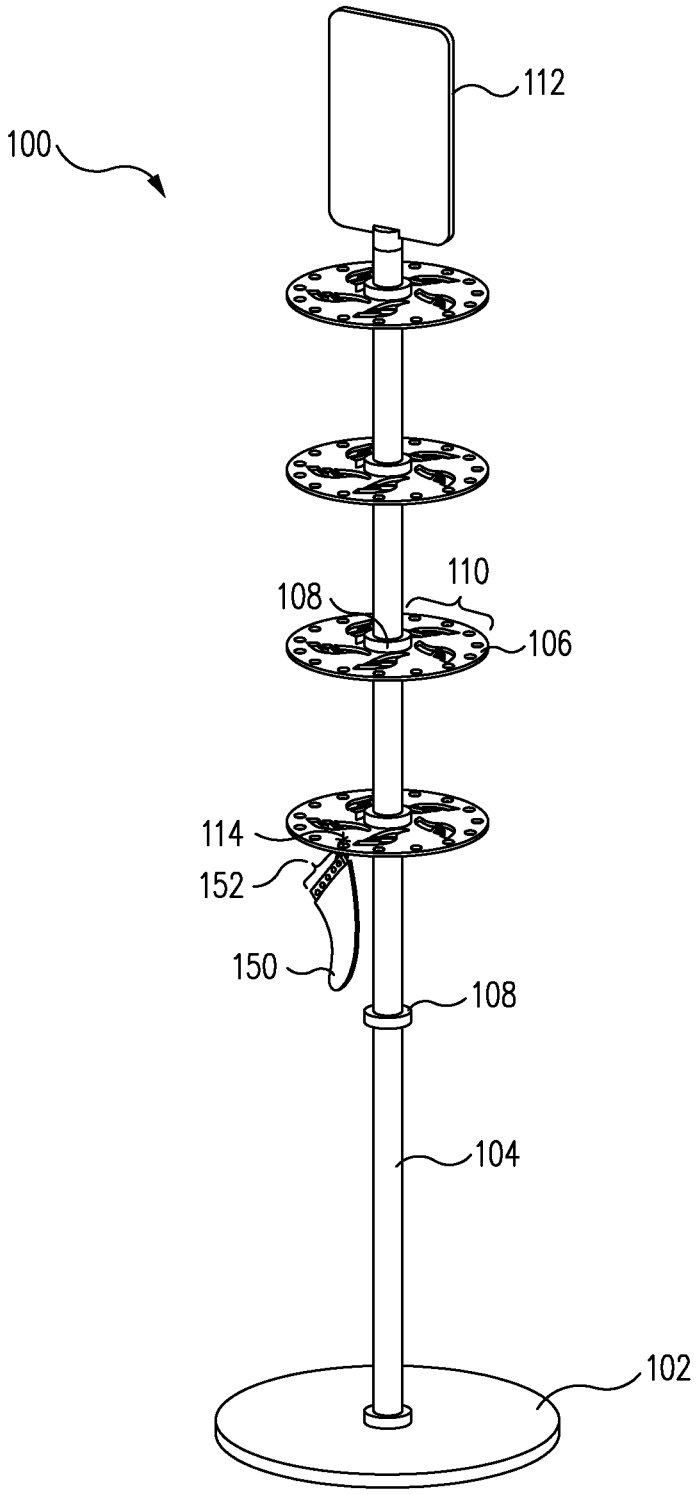
FIG. 1 illustrates a display device in accordance with an embodiment of the present invention.
Figure 2:
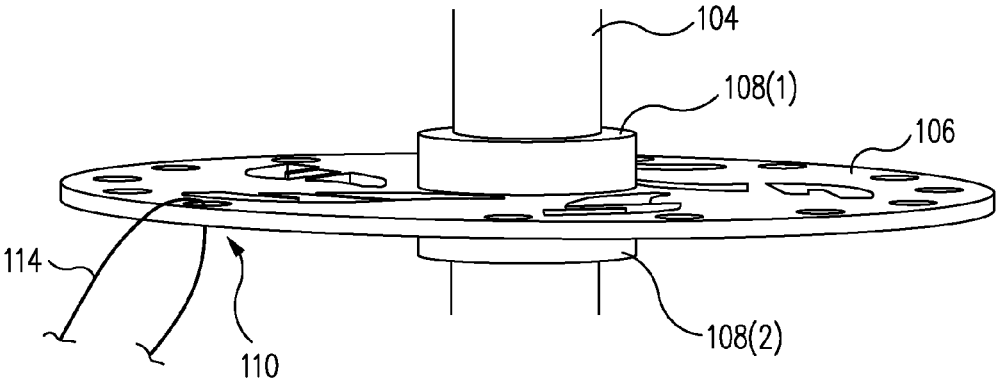
FIGS. 2-3 illustrate a support platform in accordance with an embodiment of the present invention.
Figure 3:
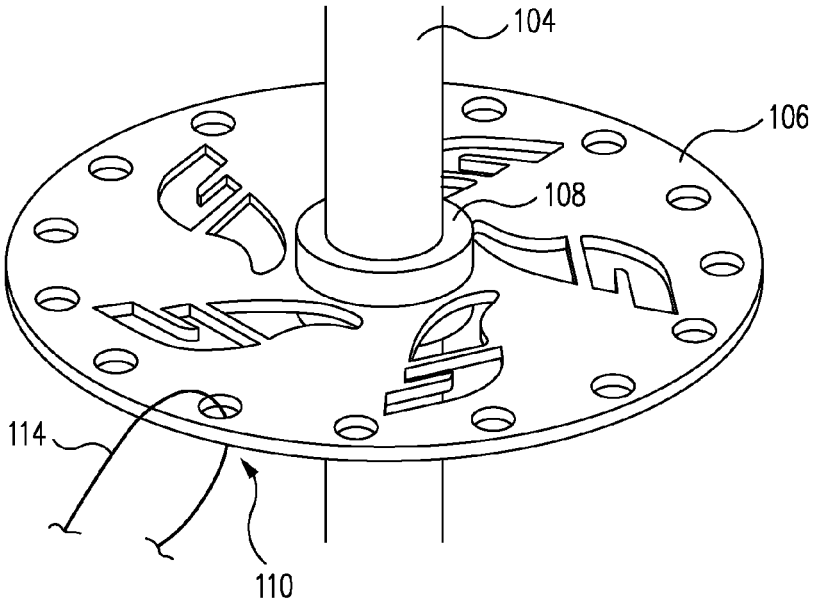

FIG. 1 illustrates a display device 100 (e.g., implemented in this embodiment as a display stand) in accordance with an embodiment of the present invention. Display device 100 may be used, for example, to display products (e.g., surfing-related products or other products) in a manner to permit consumers to handle and touch the products while still securing the products to prevent removal of the products from display device 100 by consumers. In one embodiment, display device 100 may be used to display a large number of fins, surf hardware, and product information (e.g., also referred to as sales support materials) in a relatively small retail space.

As shown in FIG. 1, display device 100 includes a base 102, a trunk 104 (e.g., also referred to as a freestanding tube or pole), a plurality of support members such as support platforms 106 (e.g., also referred to as movable circular horizontal wheels), and a sign 112. Base 102 may be implemented, for example, as a circular support as shown in FIG. 1. However, other shapes are also contemplated.

Trunk 104 is secured to base 102 and extends upward from base 102 as shown in FIG. 1. In various embodiments, trunk 104 may be implemented as a tube or a plurality of tubes (e.g., having substantially circular, square, or other cross-sections) or a plate. In other embodiments, trunk 104 may be secured to a wall, an existing surfboard rack, vertical element, or other appropriate mounting location. In such embodiments, display rack 100 may be implemented without base 102 (for example, see FIG. 11 further described herein).

Display device 100 also includes support platforms 106 which may receive one or more fins 150 or other products to be held by display device 100. Referring now to FIGS. 1-3 and 6, support platforms 106 are secured to trunk 104 by collars 108 which may be implemented, for example, as substantially circular collars configured with slits 120 (e.g., cuts in collars 108) such that the collars 108 do not form a complete circle. Screws 122 may be placed across slits 120 and tightened to cause the collars 108 to exert pressure on trunk 104. Upper and lower collars 108 may be placed above and below each support platform 106 to secure support platforms 106 to trunk 104. In this regard, each support platform 106 may be supported by a corresponding lower collar 108 (e.g., collar 108(1) in FIG. 2), and may be prevented from being moved upward by a corresponding upper collar 108 (e.g., collar 108(2) in FIG. 2).

In another embodiment, bearings may be provided between support platforms 106 and trunk 104 to permit support platforms 106 to rotate around trunk 104 (e.g., through a 360 degree rotation).

In the embodiment shown in FIG. 1, support platforms 106 are implemented as circular disks. However, other shapes may be used in different embodiments.

Support platforms 106 may be spaced along trunk 104 by appropriate distances to permit different sized products to be displayed.

Support platforms 106 include various apertures 110 (e.g., holes, slots, spaces, or other type of apertures) which may be used to hold products to be displayed and/or to provide locations for security features of display device 100.

For example, in one embodiment, apertures 100 may be configured to receive a security tether 114 (e.g., a wire, cable, rope with a loop on both ends, a tether or other appropriate security device) which threads through one or more of apertures 110 and also through an appropriate aperture 152 in a fin 150 or other product to be displayed by display device 100 (e.g., through one or more of apertures 152 in the base of fin 150 as shown in FIG. 1). In this embodiment, the ends of security tether 114 may be secured together, for example, using an appropriate standard security clip or fastener.

Figure 4:
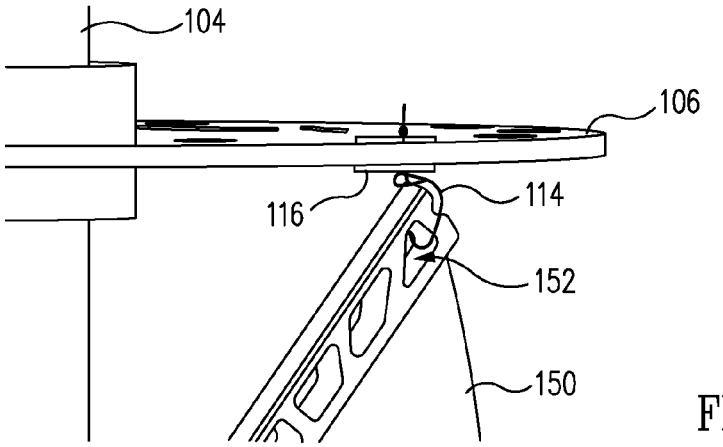
FIGS. 4-5 illustrate a fin secured to a support platform by a cam lock in accordance with an embodiment of the present invention.
Figure 5:
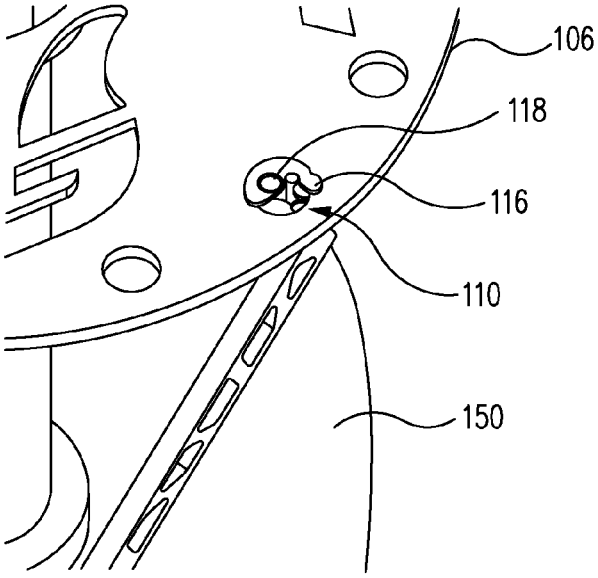
Figure 6:
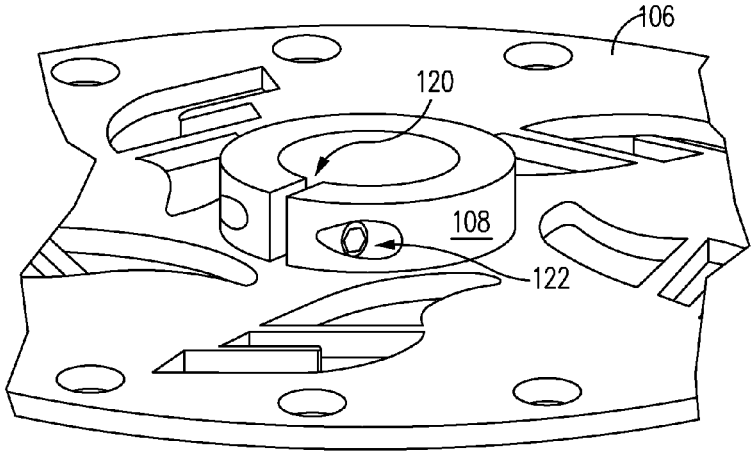
FIG. 6 illustrates a collar in accordance with an embodiment of the present invention.

Referring now to FIGS. 4-5, in another embodiment, one end of security tether 114 may thread through one of apertures 152 in the base of fin 150 and over a crimp on the other end of security tether 114. The ends of security tether 114 may be secured together. The crimped end of security tether 114 may be attached to an appropriate one of support platforms 106 by securing the crimped end in a twist cam lock 116 attached to support platform 106 and locked by an appropriate security screw 118.

Figure 7:
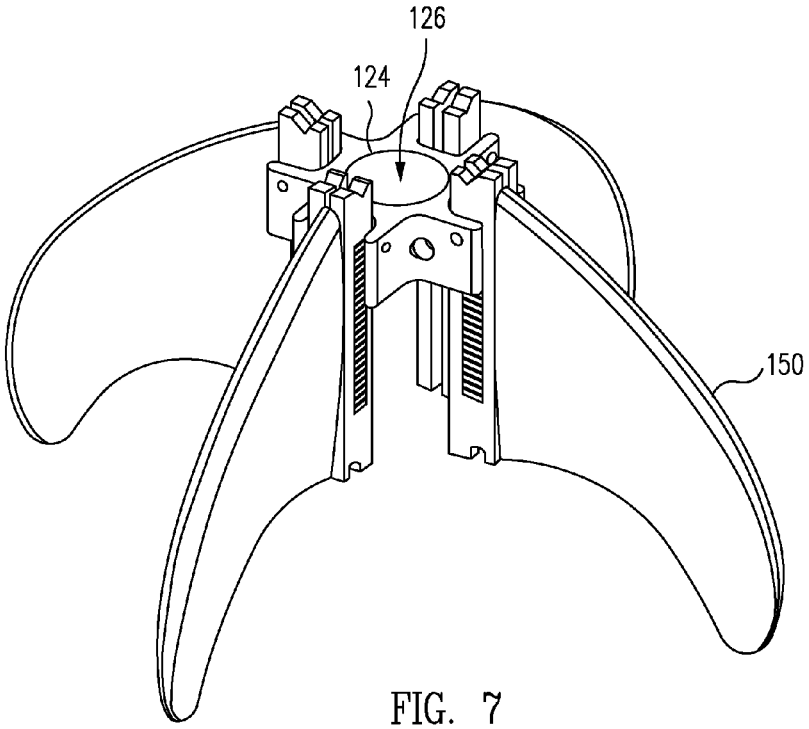
FIG. 7 illustrates a support member in accordance with an embodiment of the present invention.

Referring to FIG. 7, in another embodiment, fin 150 may be secured to display device 110 by a through hole in the base of fin 150. For example, trunk 104 may be inserted in an aperture 126 of a support member 124. In one embodiment, support member 124 may be engaged with trunk 104 in a similar manner as discussed herein with regard to collars 108. In another embodiment, support member 124 may be supported by one or more collars 108 in a similar manner as discussed herein with regard to support platform 106. As shown in FIG. 7, multiple fins 150 may be engaged with support member 124 to display fins 150 around a circumference of trunk 104 (e.g., when trunk 104 is inserted into aperture 126 of support member 124).

Figure 8:
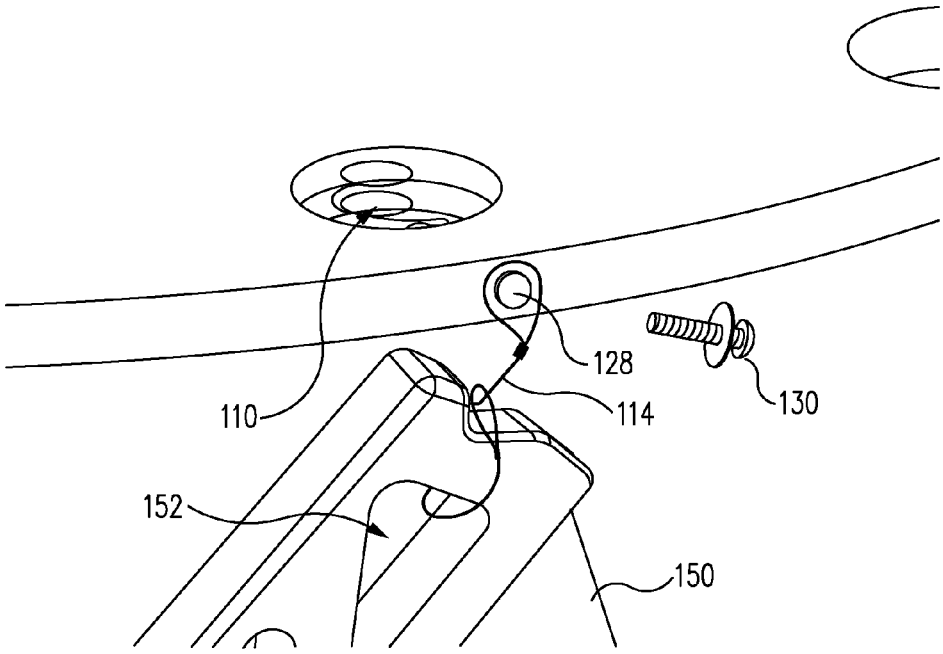
FIG. 8 illustrates a security tether configured to be secured by a security screw in accordance with an embodiment of the present invention.

Referring to FIG. 8, in another embodiment, fin 150 may be secured to display device 100 by security tether 114 which may be secured to support platform 106 by a security screw 130. In this embodiment, support platform 106 includes one or more threaded apertures 128 configured to receive security screw 130. In another embodiment, security screw 130 may pass through one or more apertures 152 in the base of fin 150 to secure fin 150 directly to support platform 106.

Figure 9:
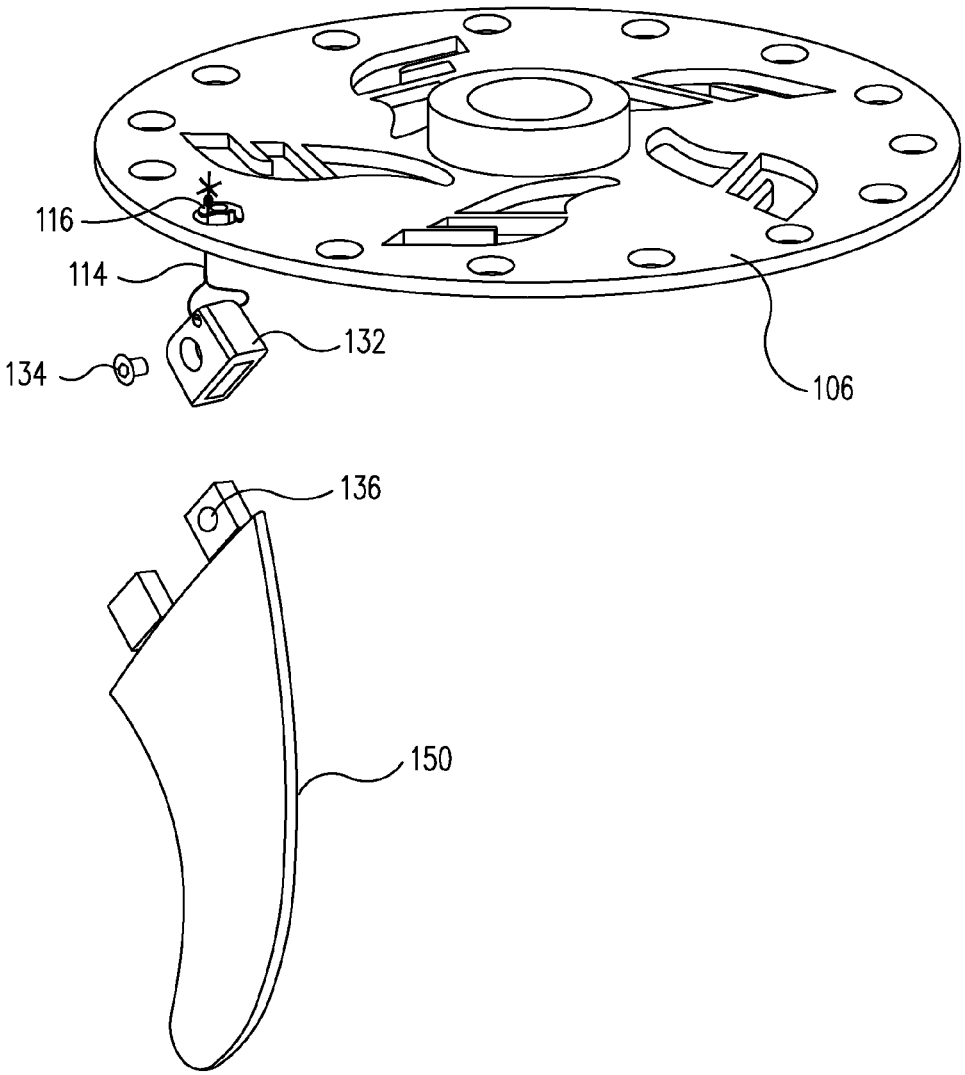
FIGS. 9-10 illustrate a receptacle configured to be secured by a security screw in accordance with an embodiment of the present invention.
Figure 10:
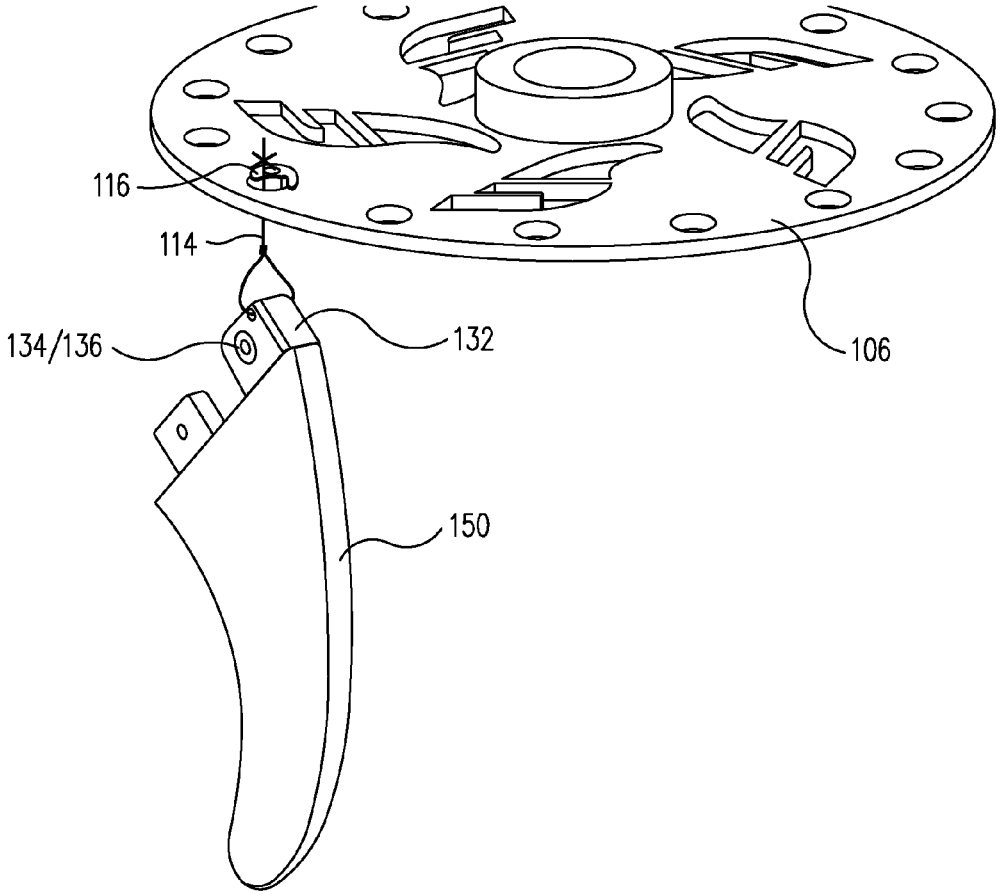

Referring to FIGS. 9-10, in another embodiment, fin 150 may be secured to support platform 106 by a molded or machined receptacle 132 that is secured to support platform 106 by security tether 114 and cam lock 116. Receptacle 132 is configured to receive a base of fin 150 which slides into receptacle 132 and is secured to receptacle 132 by an appropriate security screw 134 which also passes through an aperture 136 in the base of fin 150.

In another embodiment, display device 100 may be used to hold product literature, signs, catalogs, point of purchase displays, or other information pertaining to displayed products. For example, such information may be attached to display device 100 by collars 108. In this regard, one or more of collars 108 may include apertures configured to receive heavy gauge wire, thin metal, or other appropriate material that extends out from trunk 104 in the form of a loop (e.g., a continuous loop in the shape of half circle having a diameter smaller than that of support platforms 106) or other configuration. The edge of the loop may include a slot to hold an edge of a printed card to be positioned in proximity to fin 150.

Figure 11:
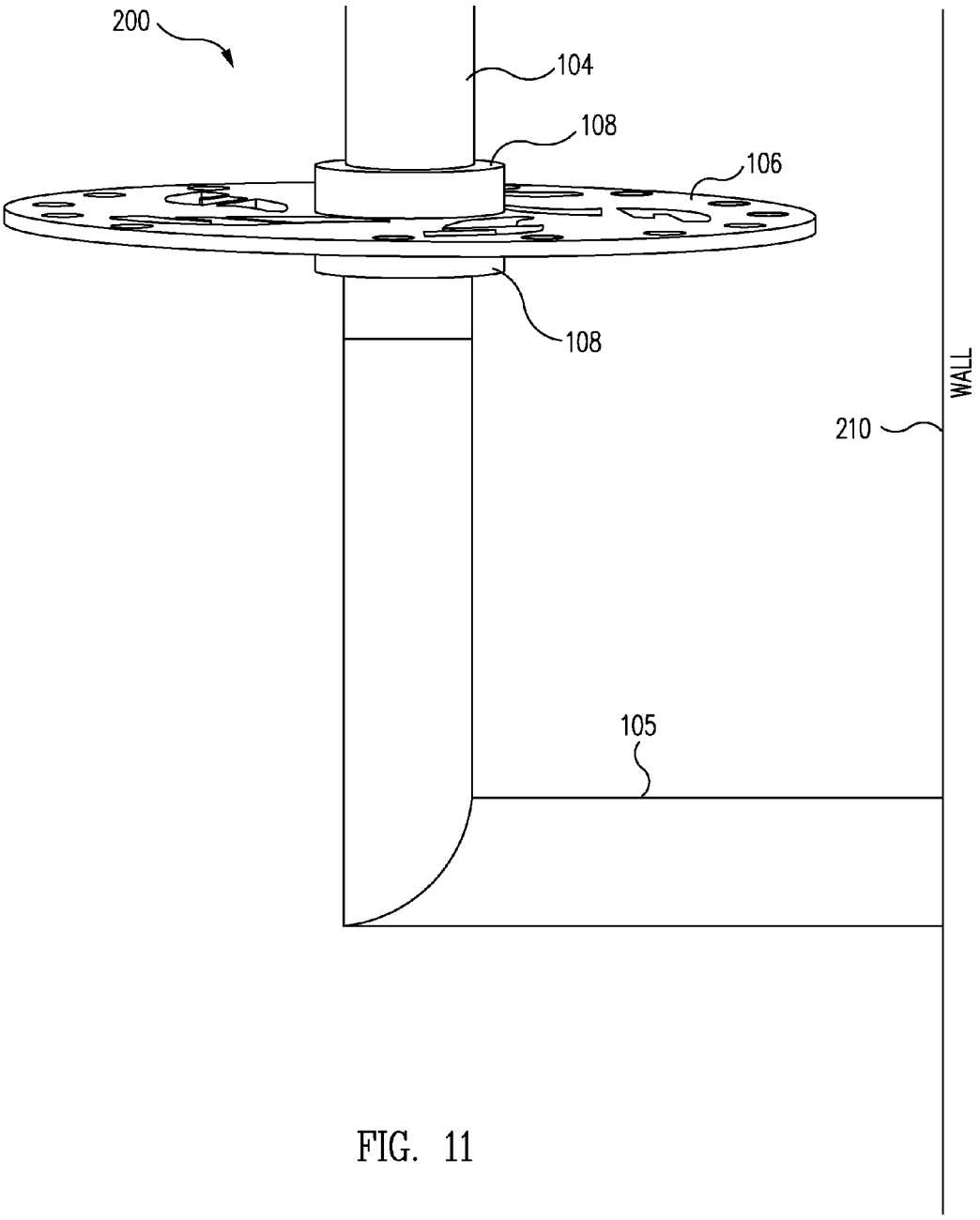
FIG. 11 illustrates a display device attached to a wall in accordance with an embodiment of the present invention.
Figure 12A:
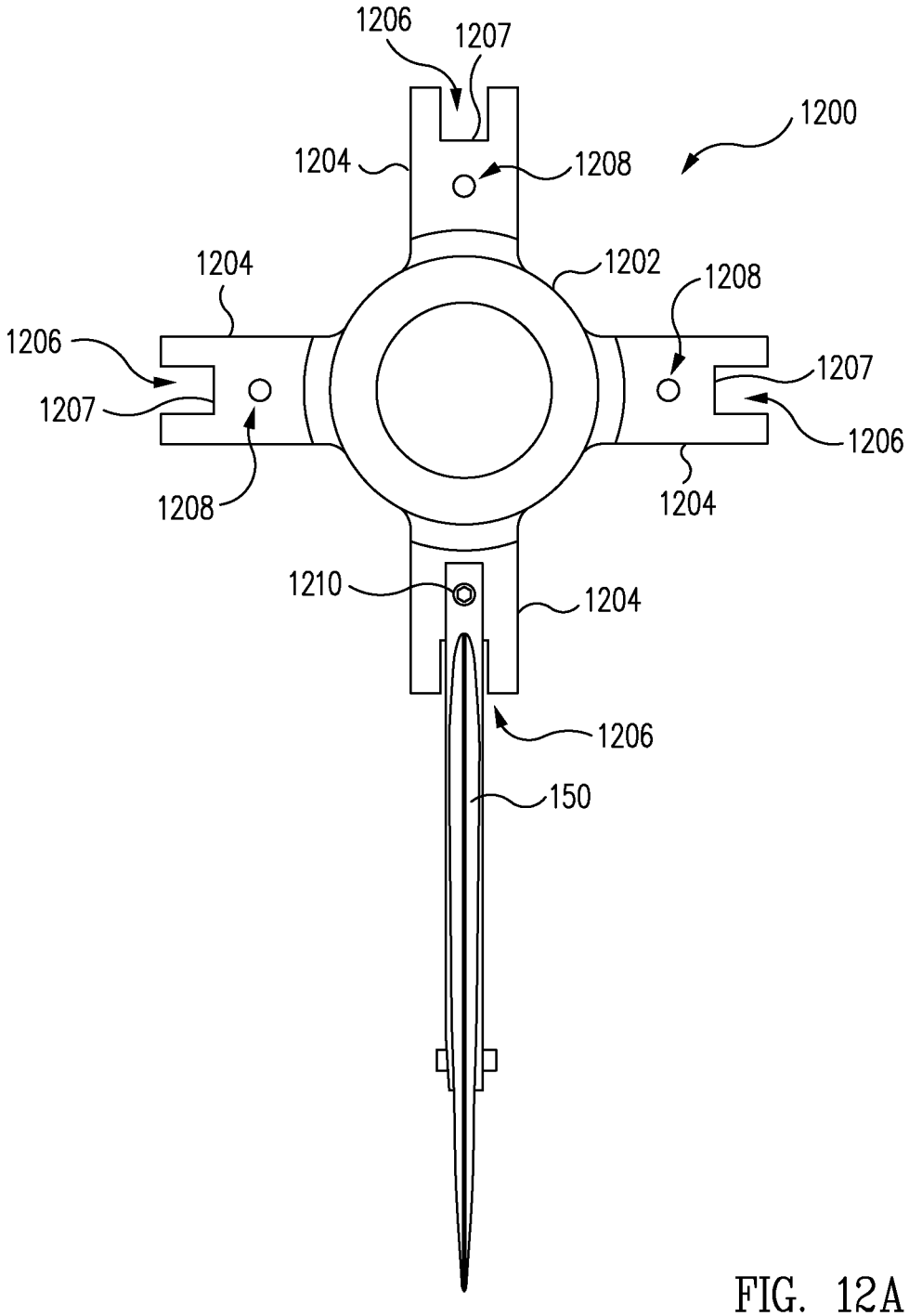
FIGS. 12A-D, 13A-D, 14A-D, and 15A-D illustrate various support members in accordance with embodiments of the present invention.
Figure 12B:
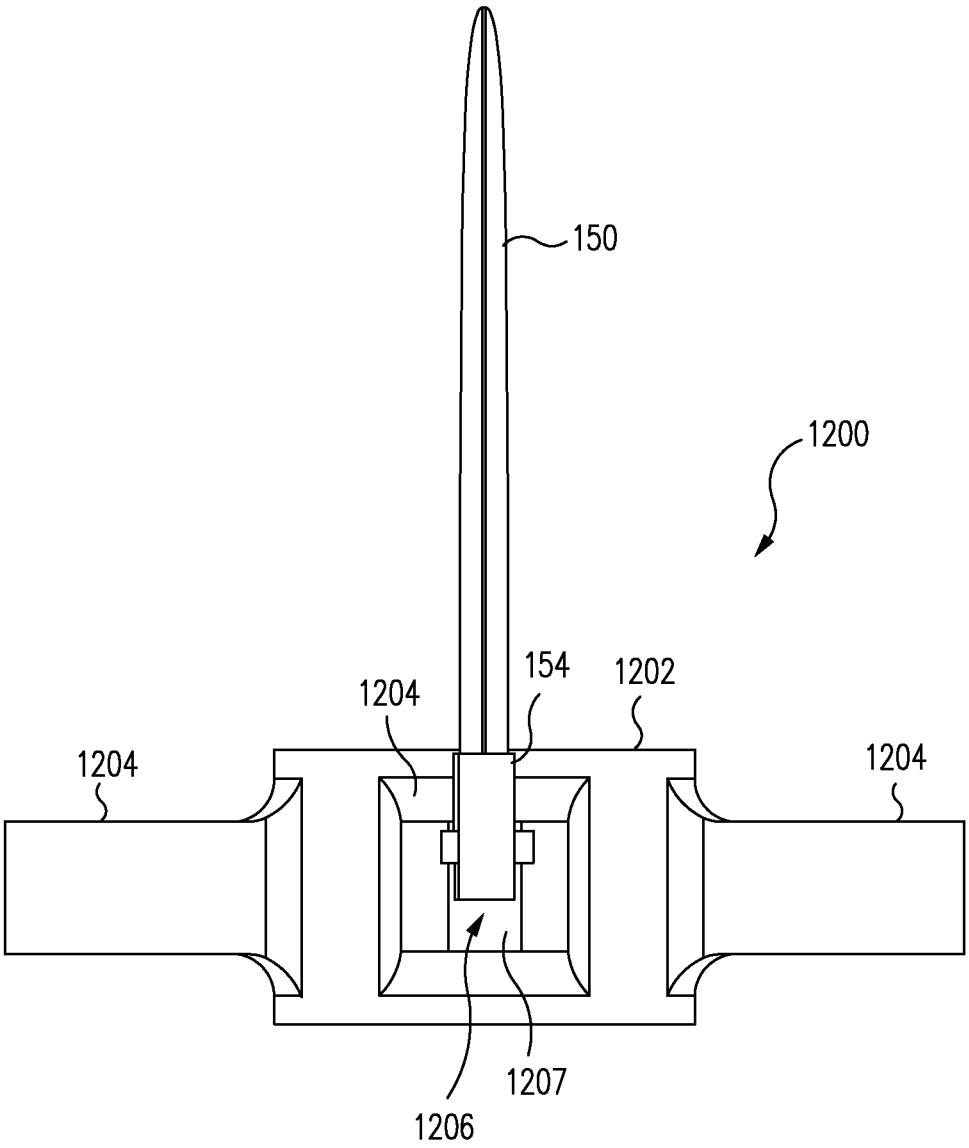
Figure 12C:
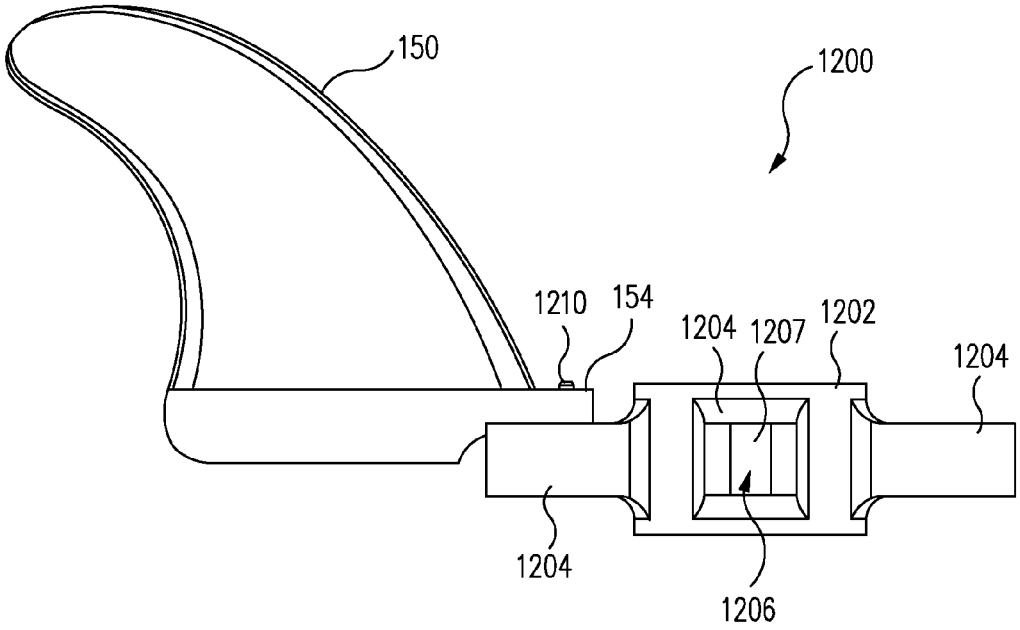
Figure 12D:
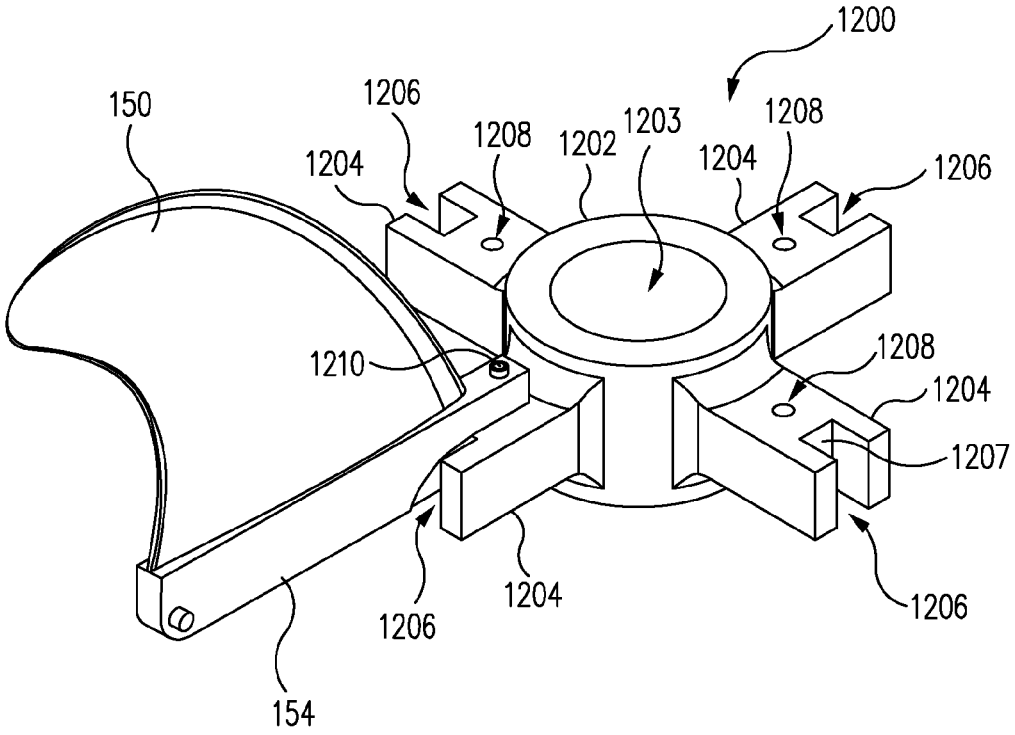
Figure 13A:
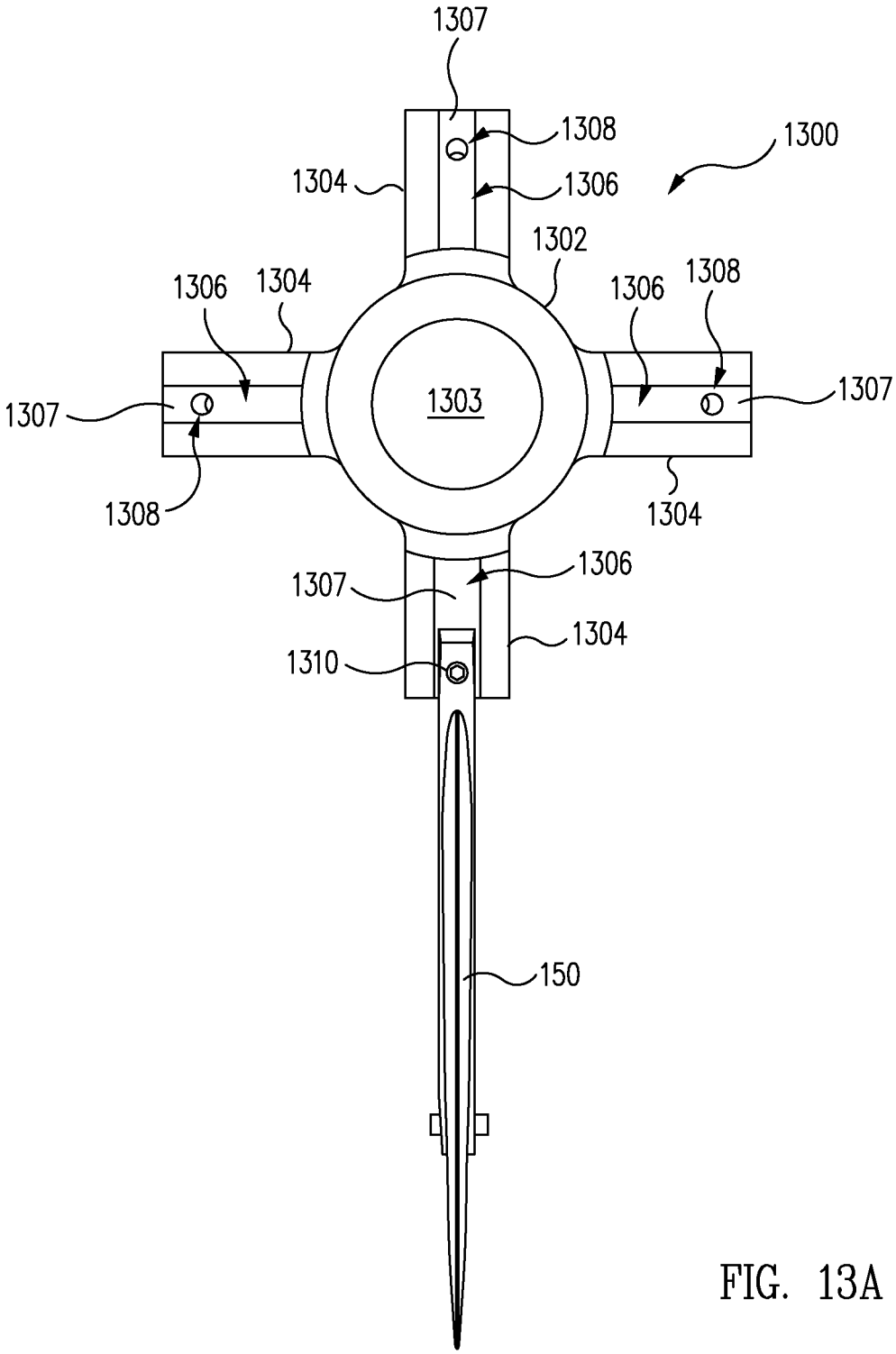
Figure 13B:
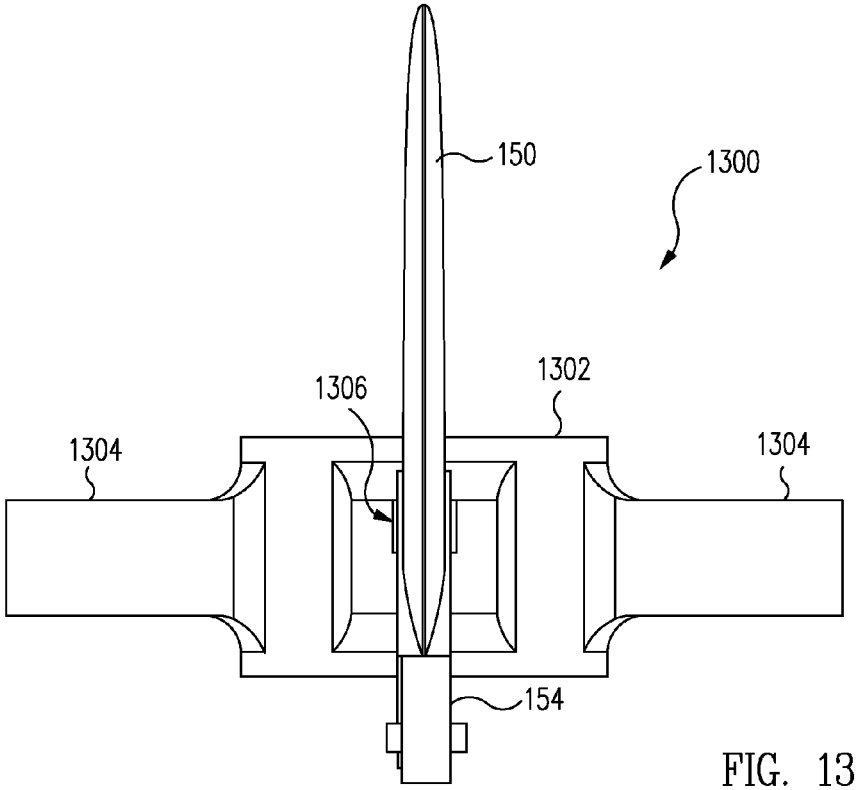
Figure 13C:
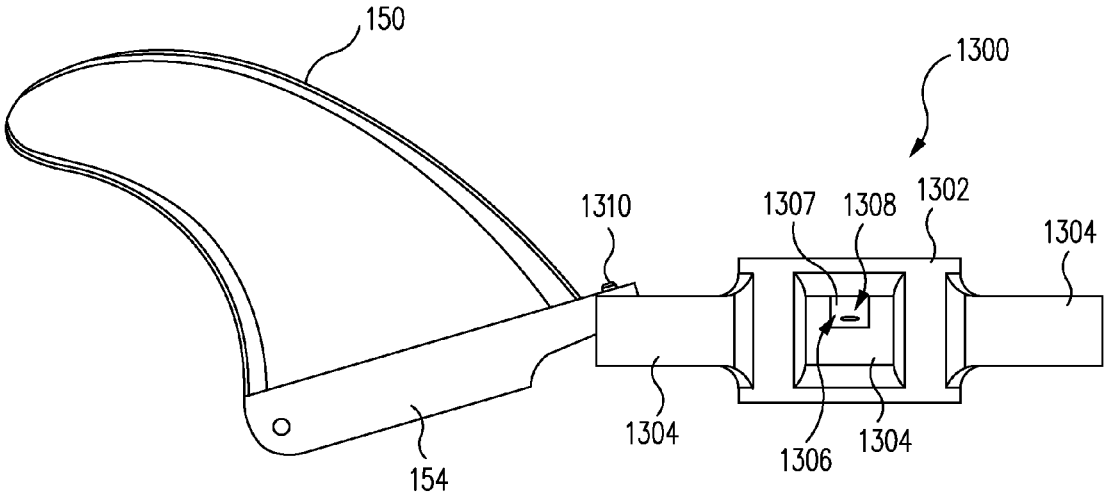
Figure 13D:
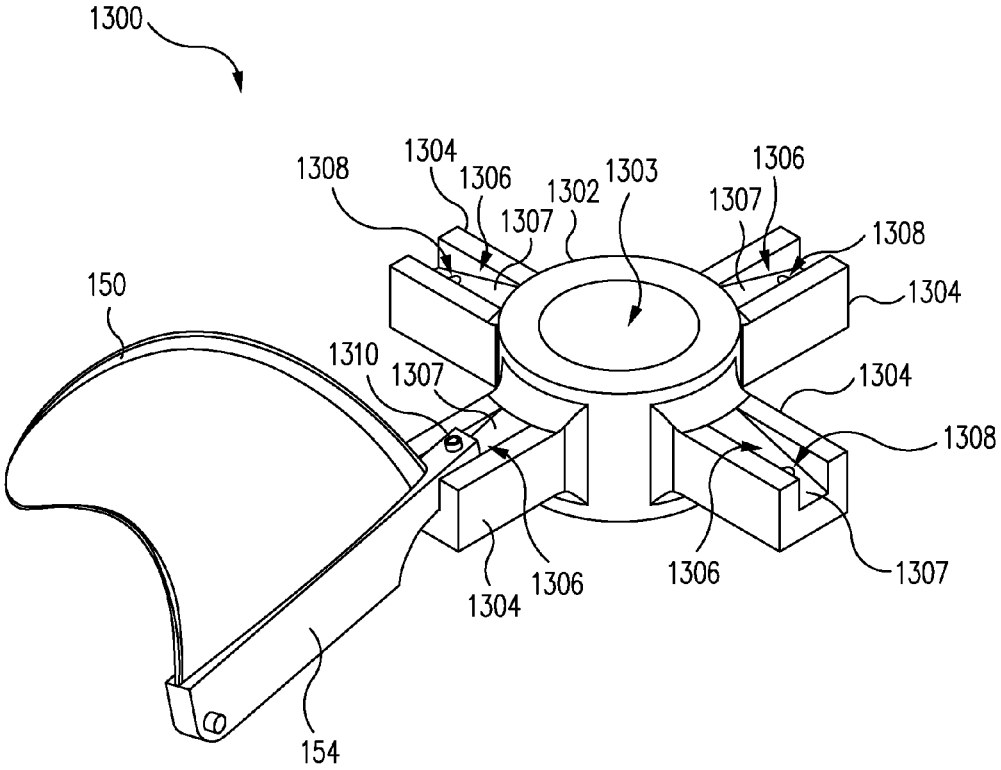
Figure 14A:
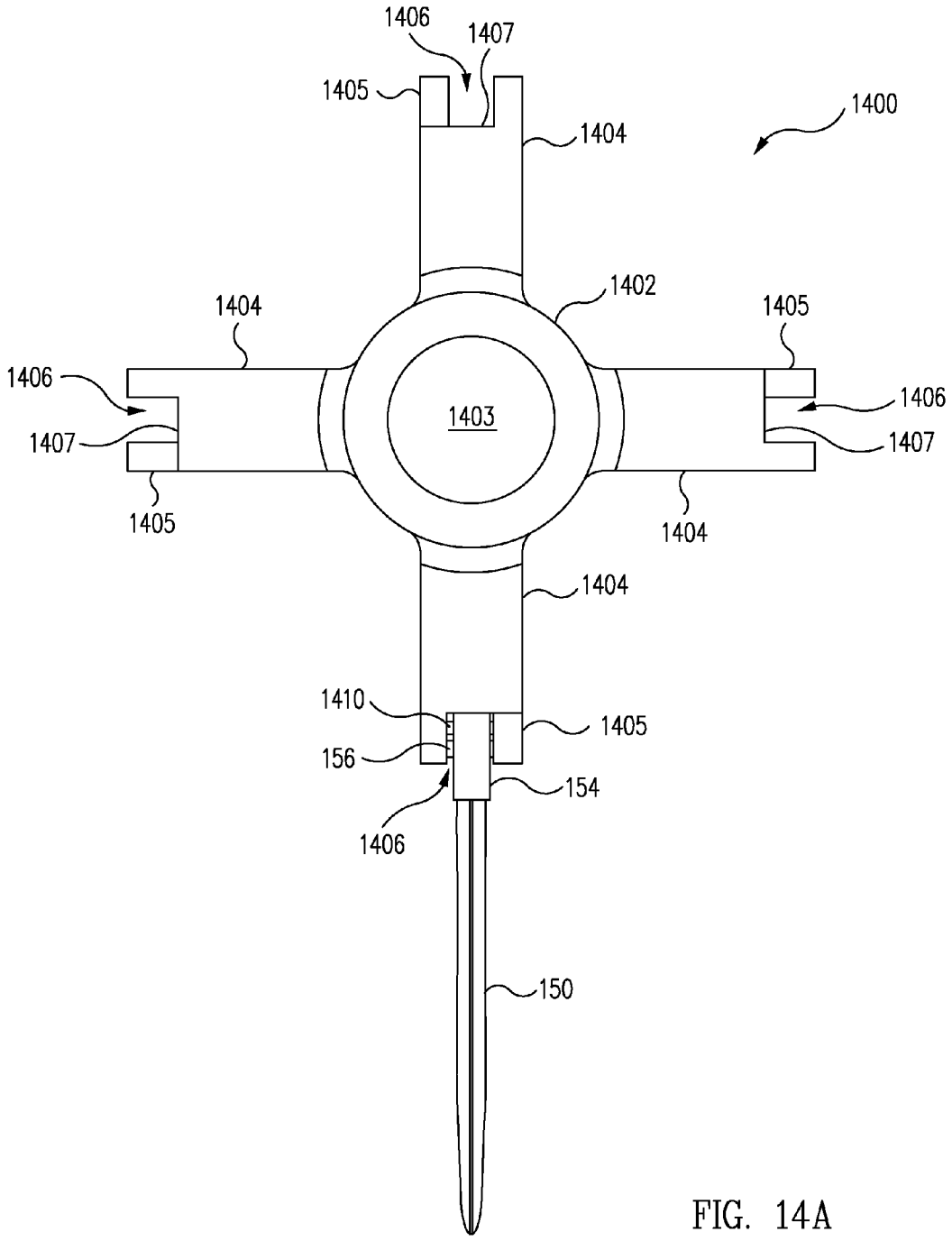
Figure 14B:
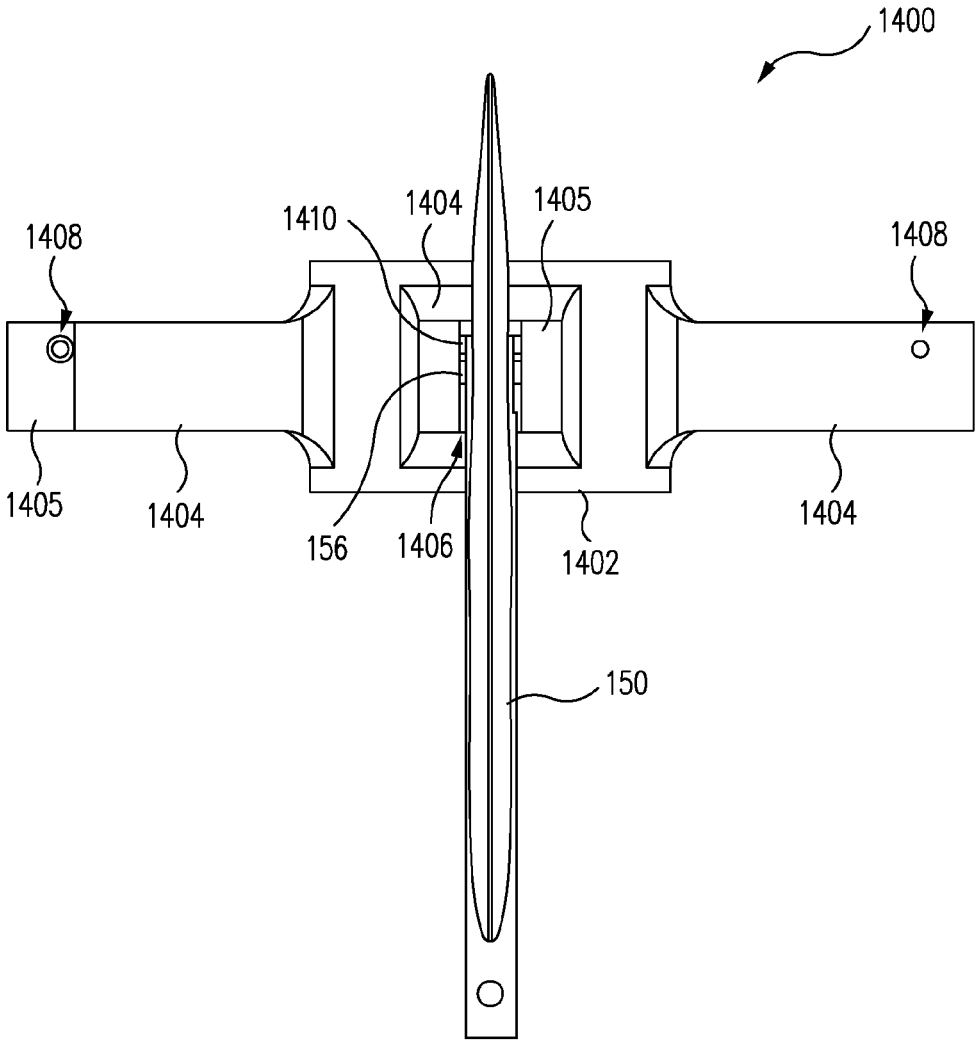
Figure 14C:
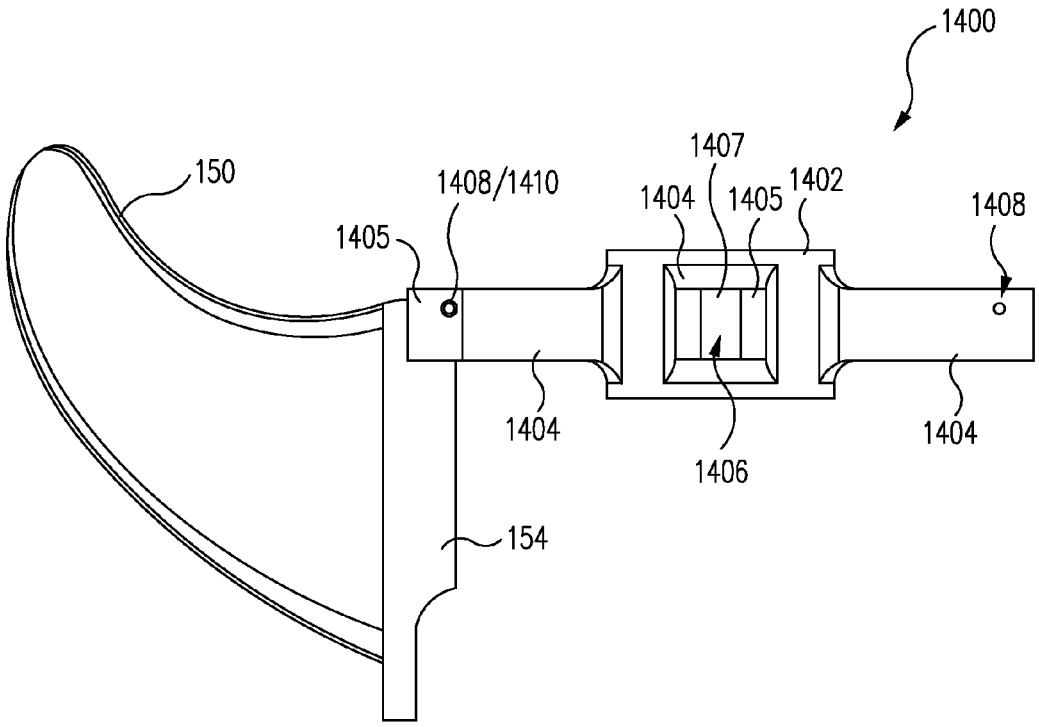
Figure 14D:
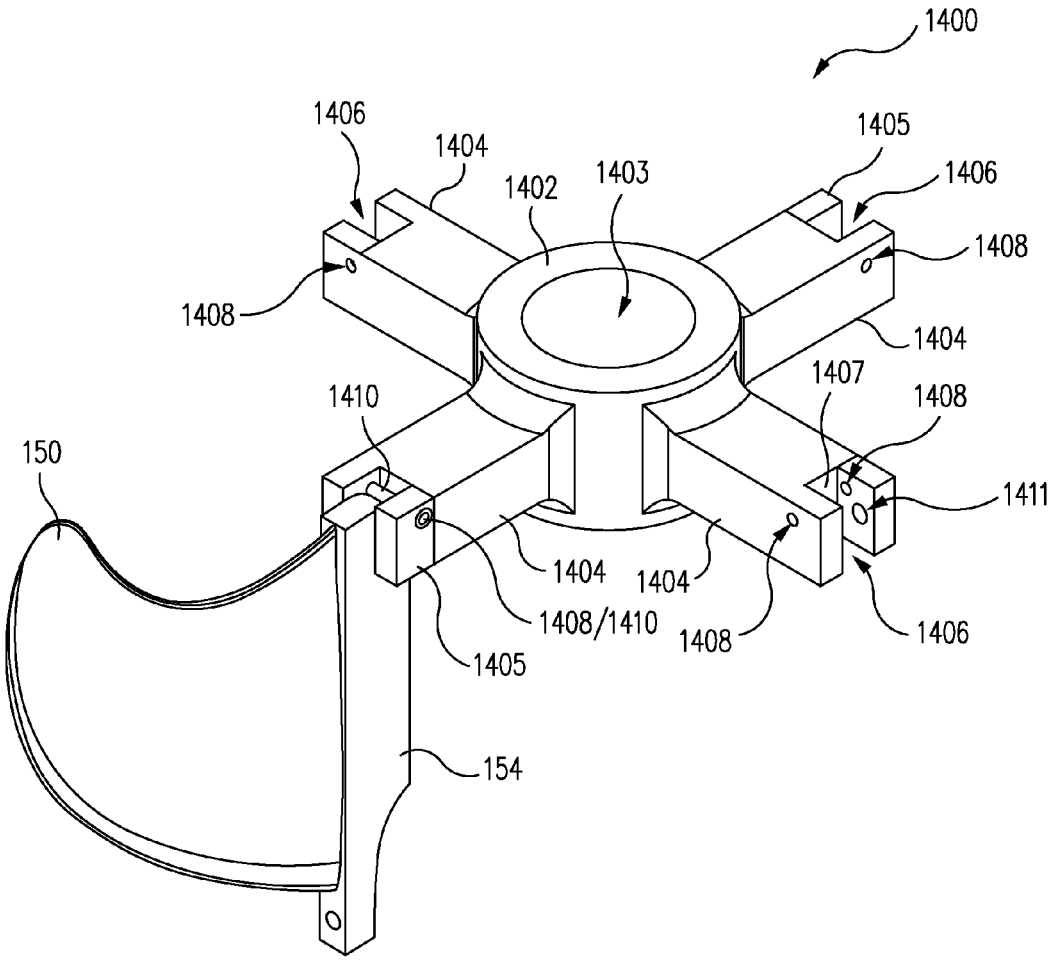
Figure 15A:
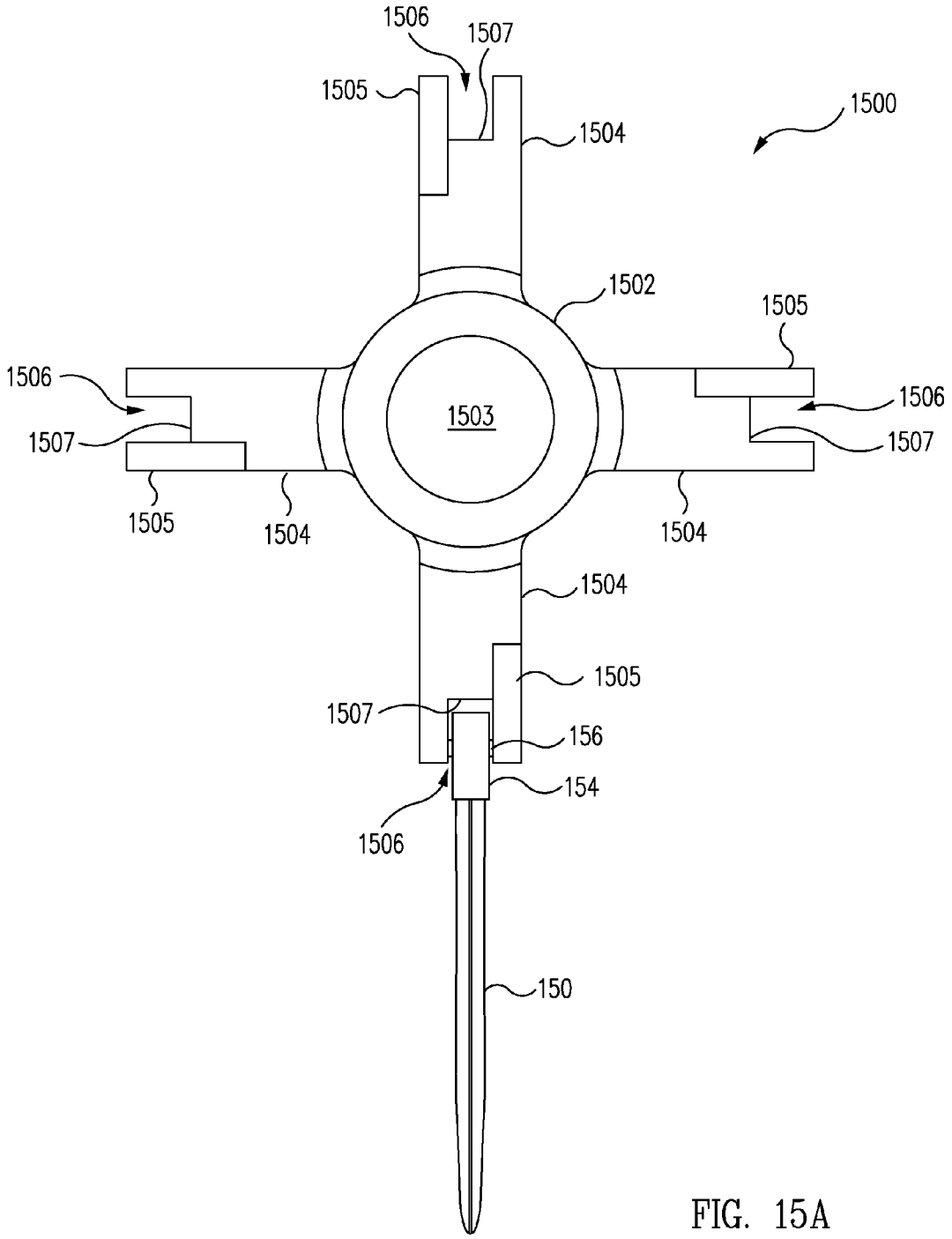
Figure 15B:
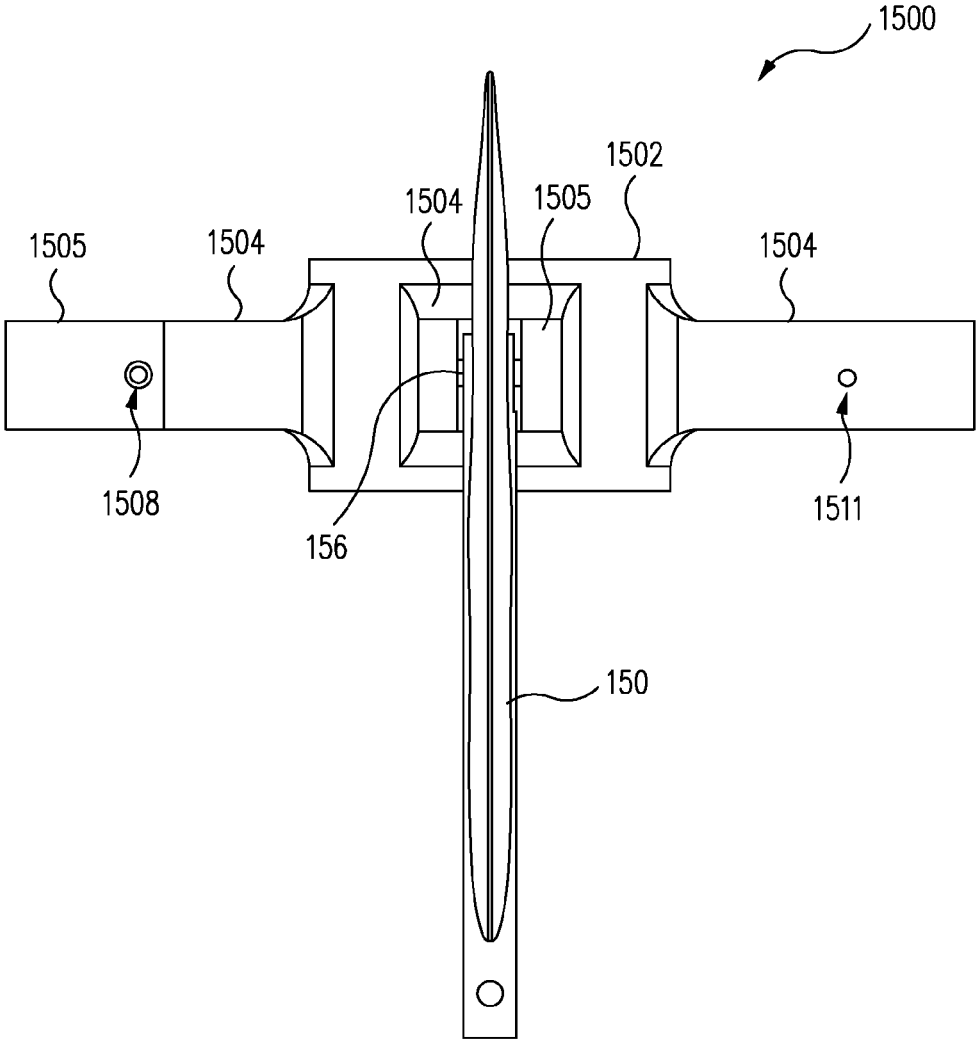
Figure 15C:
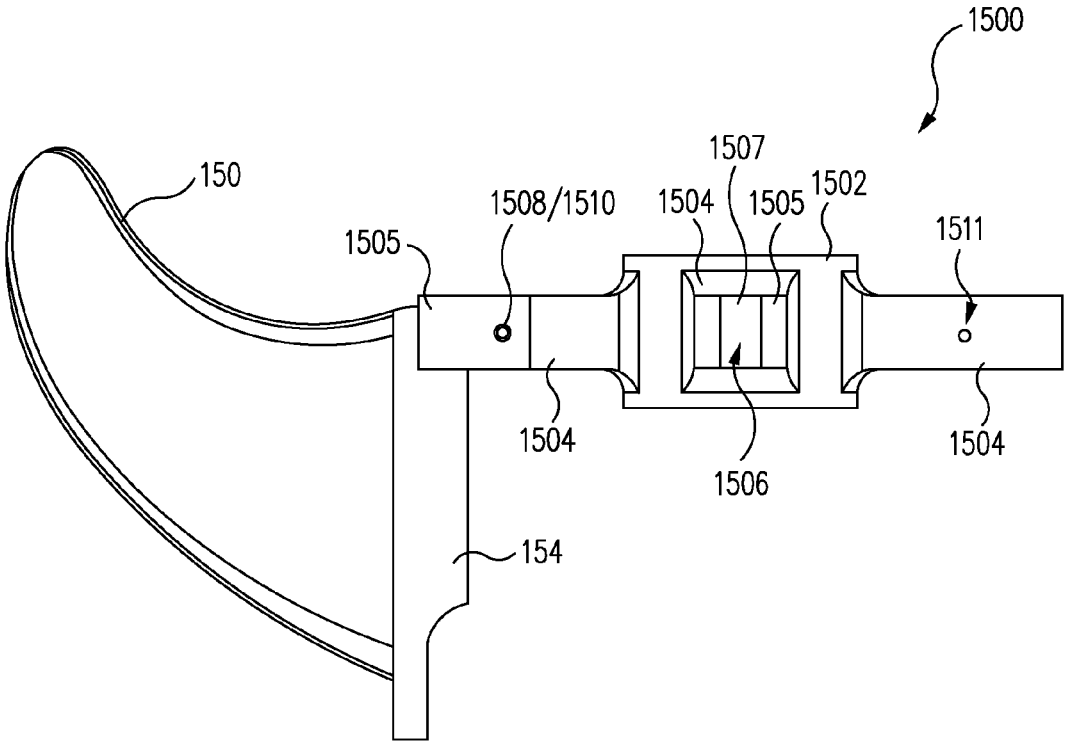
Figure 15D:
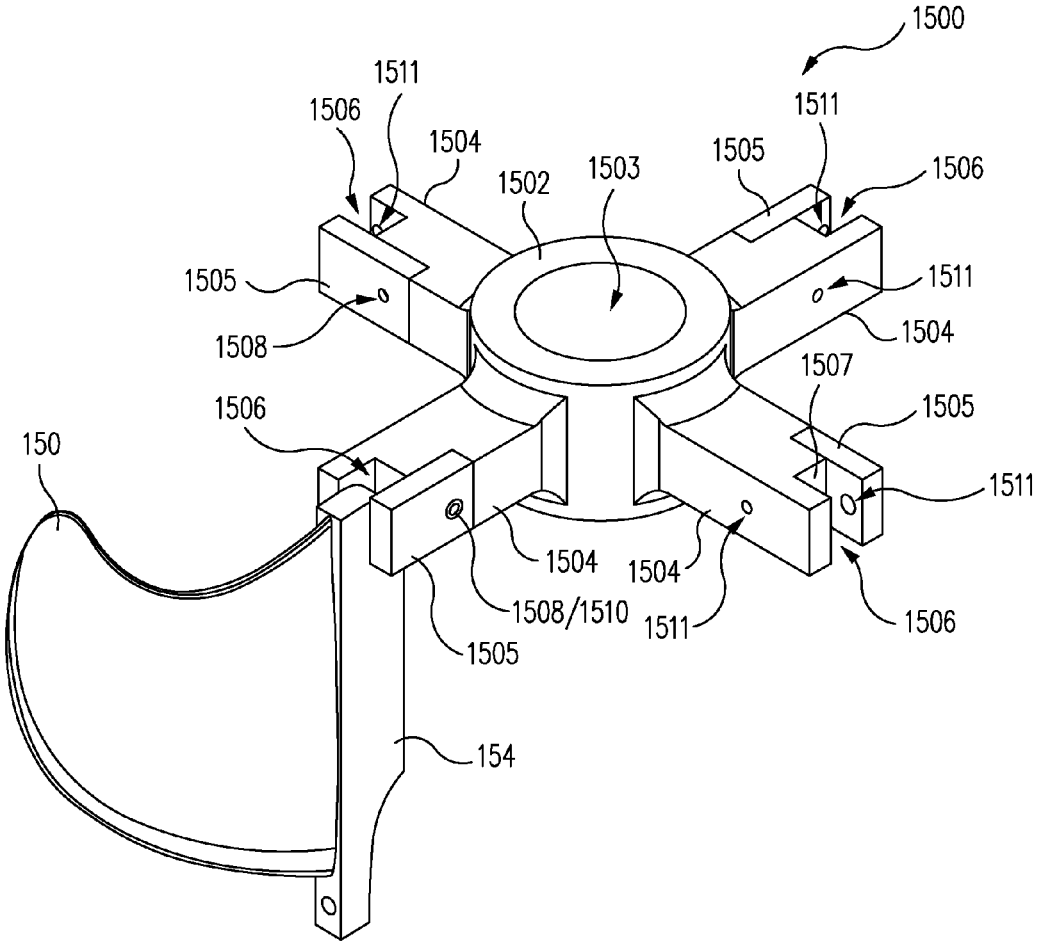

Referring to FIG. 11, in another embodiment, a display device 200 is shown mounted to a wall 210 by a wall support member 105 connected to trunk 104. The various aspects of display device 100 as described herein may be implemented in display device 200 where appropriate.

Other types of support members are also contemplated. For example, FIGS. 12A-D, 13A-D, 14A-D, and 15A-D illustrate various support members in accordance with embodiments of the present invention. In various embodiments, the support members of FIGS. 12A-D, 13A-D, 14A-D, and 15A-D may be engaged with trunk 104 in a similar manner as discussed herein with regard to collars 108, or may be supported by one or more collars 108 in a similar manner as discussed herein with regard to support platform 106.

FIGS. 12A-D illustrate a support member 1200 including a hub 1202, an aperture 1203 which may receive trunk 104 therethrough, and a plurality of branches 1204 which may support one or more fins 150. Branches 1204 include recesses 1206 and apertures 1208. Recesses 1206 define recessed surfaces 1207 which are substantially perpendicular to trunk 104 when support member 1200 is mounted on trunk 104 (e.g., while trunk 104 is inserted through aperture 1203). Each recess 1206 may receive a base 154 of a corresponding fin 150 which is secured to support member 1200 by a security screw 1210 inserted through base 154 and screwed into a corresponding aperture 1208. As a result, one or more fins 150 may be displayed in a substantially vertical orientation as shown in FIGS. 12A-D FIGS. 13A-D illustrate a support member 1300 including a hub 1302, an aperture 1303 which may receive trunk 104 therethrough, and a plurality of branches 1304 which may support one or more fins 150. Branches 1304 include recesses 1306 and apertures 1308. Recesses 1306 define recessed surfaces 1307 which are inclined relative to trunk 104 when support member 1300 is mounted on trunk 104 (e.g., while trunk 104 is inserted through aperture 1303). Each recess 1306 may receive a base 154 of a corresponding fin 150 which is secured to support member 1300 by a security screw 1310 inserted through base 154 and screwed into a corresponding aperture 1308. As a result, one or more fins 150 may be displayed in a substantially inclined orientation as shown in FIGS. 13A-D.

FIGS. 14A-D illustrate a support member 1400 including a hub 1402, an aperture 1403 which may receive trunk 104 therethrough, and a plurality of branches 1404 which may support one or more fins 150. Branches 1404 include recesses 1406 and apertures 1408. Recesses 1406 define recessed surfaces 1407 which are substantially perpendicular to trunk 104 when support member 1400 is mounted on trunk 104 (e.g., while trunk 104 is inserted through aperture 1403). Each recess 1406 may receive a base 154 of a corresponding fin 150.

Branches 1404 also include clamp members 1405, apertures 1408, and apertures 1411. Apertures 1411 may receive a pin 156 of fin 150. Fin 150 is secured to support member 1400 by a security screw 1410 inserted through base 154 and screwed into apertures 1408 on substantially opposite sides of recess 1406. As security screw 1410 is tightened, the corresponding clamp member 1405 is urged against, and applies pressure to, base 154 of the corresponding fin 150 such that base 154 is held in place. As a result, one or more fins 150 may be displayed in a substantially horizontal orientation as shown in FIGS. 14A-D.

FIGS. 15A-D illustrate a support member 1500 including a hub 1502, an aperture 1503 which may receive trunk 104 therethrough, and a plurality of branches 1504 which may support one or more fins 150. Branches 1504 include recesses 1506 and apertures 1508. Recesses 1506 define recessed surfaces 1507 which are substantially perpendicular to trunk 104 when support member 1500 is mounted on trunk 104 (e.g., while trunk 104 is inserted through aperture 1503). Each recess 1506 may receive a base 154 of a corresponding fin 150.

Branches 1504 also include clamp members 1505, apertures 1508, and apertures 1511. Apertures 1511 may receive a pin 156 of fin 150. A security screw 1510 is inserted through aperture 1508 and screwed into an aperture (e.g., a blind hole) of branch 1504 to hold clamp member 1505 in a fixed position relative to an opposite side of branch 1504. While clamp member 1505 is held in the fixed position, pin 156 of fin 150 remains engaged with apertures 1511 and secured to support member 1500. Because clamp member 1505 does not apply pressure directly against base 154 of fin 150 in this embodiment, fin 150 remains free to rotate about pin 156 while fin 150 still remains secured to support member 1500.

Embodiments described above illustrate but do not limit the invention. It should also be understood that numerous modifications and variations are possible in accordance with the principles of the present invention. Accordingly, the scope of the invention is defined only by the following claims.

What is claimed is:

1. A display device for surfboard fins comprising:

a trunk;

a support member comprising:

a substantially solid thin planar disk defining a continuous circular outer perimeter of the support member, a central aperture adapted to receive the trunk therethrough, and a perimeter aperture positioned substantially near the perimeter of the support member;

a security tether adapted to attach to the support member using the perimeter aperture and adapted to secure a surfboard fin to the support member for display in a suspended position entirely below the support member while permitting manipulation by a consumer and limiting removal of the surfboard fin from the display device by the consumer; and a security screw adapted to insert through the perimeter aperture to secure the security tether relative to the support member.

2. The display device of claim 1, further comprising:

a collar adapted to secure the support member to the trunk, wherein the collar is adapted to contact at least the bottom surface of the support member to hold the support member at least at a display position relative to a bottom end of the trunk, wherein the collar comprises an aperture adapted to receive the trunk therethrough.

3. The display device of claim 1, further comprising a sign adapted to be mounted on a top end of the trunk.

4. The display device of claim 1, further comprising a base adapted to receive the trunk to hold the trunk in a substantially vertical position.

5. The display device of claim 1, further comprising a wall support member adapted to receive the trunk to hold the trunk in a substantially vertical position.

6. The display device of claim 1, wherein the support member is adapted to rotate relative to the trunk to facilitate convenient access to substantially an entire top surface of the support member by the consumer.

7. The display device of claim 2, wherein the collar is a substantially circular collar, wherein the collar comprises a slit extending from an outer surface of the collar to the aperture of the collar, wherein the slit defines substantially opposite surfaces of the collar, wherein the collar is adapted to receive a screw across the slit to pull the opposite sides together to exert pressure on the trunk to hold the collar at a substantially fixed position on the trunk substantially near the display position.

8. The display device of claim 2, wherein the collar is a lower collar, the display device further comprising an upper collar adapted to prevent the support member from being moved upward relative to the trunk.

9. The display device of claim 1, further comprising a twist cam lock adapted to engage the perimeter aperture and secure a crimped end of the security tether to the support member.

10. The display device of claim 1, wherein the display device further comprises a receptacle adapted to be secured to the support member by the security tether, wherein the receptacle is adapted to receive the surfboard fin for display and manipulation by the consumer.

11. The display device of claim 1, further comprising:

a collar adapted to secure the support member to the trunk, wherein the collar comprises:

an aperture adapted to receive the trunk therethrough, a slit extending from an outer surface of the collar to the central aperture of the support member, wherein the slit defines substantially opposite surfaces, and wherein the collar is adapted to receive a screw across the slit to pull the opposite sides together to exert pressure on the trunk to hold the support member at the display position relative to the bottom end of the trunk.

12. The display device of claim 1, wherein the support member is a first support member, the surfboard fin is a first surfboard fin, wherein the display device comprises a second support member comprising:

a hub;

at least one branch connected to the hub and adapted to support a second surfboard fin, wherein the branch comprises a security aperture and a recess defining a recessed surface substantially perpendicular to the trunk, wherein the recess is adapted to receive the second surfboard fin for display in a substantially vertical orientation; and a second security screw adapted to insert through the second surfboard fin and screw into the security aperture.

13. The display device of claim 1, wherein the support member is a first support member, the surfboard fin is a first surfboard fin, wherein the display device comprises a second support member comprising:

a hub;

at least one branch connected to the hub and adapted to support a second surfboard fin, wherein the branch comprises a security aperture and a recess defining a recessed surface inclined relative to the trunk, wherein the recess is adapted to receive the second surfboard fin for display in a substantially inclined orientation relative to the trunk; and a second security screw adapted to insert through the second surfboard fin and screw into the security aperture.

14. The display device of claim 1, wherein the support member is a first support member, the surfboard fin is a first surfboard fin, wherein the display device comprises a second support member comprising:

a hub;

at least one branch connected to the hub and adapted to support a second surfboard fin, wherein the branch comprises a clamp member, a security aperture, and a recess, wherein the recess is adapted to receive the second surfboard fin for display; and a second security screw adapted to insert through the clamp member and screw into the security aperture to exert pressure on the second surfboard fin to secure the second surfboard fin to the display device.

15. A display device comprising:

a trunk;

a support member comprising an aperture adapted to receive the trunk therethrough;

a security member adapted to secure an item to the support member for display and manipulation by a consumer and limit removal of the item from the display device by the consumer;

a collar adapted to secure the support member to the trunk, wherein the collar is adapted to contact at least a bottom surface of the support member to hold the support member at least at a display position relative to a bottom end of the trunk, wherein the collar comprises an aperture adapted to receive the trunk therethrough; and wherein the support member comprises:

a hub, at least one branch connected to the hub and adapted to support the item, wherein the branch comprises a clamp member, a security aperture, a pin aperture adapted to receive a pin of the item, and a recess, wherein the recess is adapted to receive the item for display, and wherein the security member is a security screw adapted to insert through the clamp member and screw into the security aperture to secure the item to the display device without exerting pressure on the item so as to permit the item to rotate about the pin while the item remains secured to the display device.

16. A method of securing the surfboard fin to the display device of claim 1, the method comprising:

attaching the surfboard fin to the security tether; and attaching the security tether to the support member.

17. A display device comprising:

a trunk;

a support member comprising an aperture adapted to receive the trunk therethrough;

a security member adapted to secure an item to the support member for display and manipulation by a consumer and limit removal of the item from the display device by the consumer;

wherein the support member comprises a slit extending from an outer surface of the support member to the aperture of the support member;

wherein the slit defines substantially opposite surfaces of the support member;

wherein the support member is adapted to receive a screw across the slit to pull the opposite sides together to exert pressure on the trunk to hold the support member at a display position relative to a bottom end of the trunk; and wherein the support member comprises:

a hub, at least one branch connected to the hub and adapted to support the item, wherein the branch comprises a clamp member, a security aperture, a pin aperture adapted to receive a pin of the item, and a recess, wherein the recess is adapted to receive the item for display, and wherein the security member is a security screw adapted to insert through the clamp member and screw into the security aperture to secure the item to the display device without exerting pressure on the item so as to permit the item to rotate about the pin while the item remains secured to the display device.

18. The display device of claim 17, wherein the support member is a first support member, the item is a first item, the display position is a first display position, the security member is a first security member, the display device further comprising:

a second support member comprising an aperture adapted to receive the trunk therethrough;

a second security member adapted to secure a second item to the second support member for display and manipulation by the consumer without permitting complete removal of the second item from the display device by the consumer; and a collar adapted to secure the second support member to the trunk, wherein the collar is adapted to contact at least a bottom surface of the second support member to hold the second support member at least at a second display position relative to the bottom end of the trunk, wherein the collar comprises an aperture adapted to receive the trunk therethrough.

19. The display device of claim 17, wherein the support member is a first support member, the item is a first item, wherein the display device comprises a second support member comprising:

a hub;

at least one branch connected to the hub and adapted to support a second item, wherein the branch comprises a security aperture and a recess defining a recessed surface substantially perpendicular to the trunk, wherein the recess is adapted to receive the second item for display in a substantially vertical orientation; and wherein the security member is a security screw adapted to insert through the second item and screw into the security aperture.

20. The display device of claim 17, wherein the support member is a first support member, the item is a first item, wherein the display device comprises a second support member comprising:

a hub;

at least one branch connected to the hub and adapted to support a second item, wherein the branch comprises a security aperture and a recess defining a recessed surface inclined relative to the trunk, wherein the recess is adapted to receive the second item for display in a substantially inclined orientation relative to the trunk; and wherein the security member is a security screw adapted to insert through the second item and screw into the security aperture.

21. The display device of claim 17, wherein the support member is a first support member, the item is a first item, wherein the display device comprises a second support member comprising:

a hub;

at least one branch connected to the hub and adapted to support a second item, wherein the branch comprises a clamp member, a security aperture, and a recess, wherein the recess is adapted to receive the second item for display; and wherein the security member is a security screw adapted to insert through the clamp member and screw into the security aperture to exert pressure on the second item to secure the second item to the display device.

22. A method of securing the item to the display device of claim 17, the method comprising:

attaching the item to the security member; and attaching the security member to the support member.

23. The display device of claim 1, wherein the perimeter aperture extends through top and bottom surfaces of the support member.

24. The display device of claim 1, wherein the security screw directly contacts the security tether.

* * * * *